US011824306B2

(12) United States Patent
Goñi Mateos et al.

(10) Patent No.: US 11,824,306 B2
(45) Date of Patent: Nov. 21, 2023

(54) CONNECTOR FOR SUPPLYING ELECTRIC POWER

(71) Applicant: VALCO MELTON, S.L.U., Orcoyen (ES)

(72) Inventors: Víctor Goñi Mateos, Orcoyen (ES); Gonzalo Marco Nain, Orcoyen (ES)

(73) Assignee: VALCO MELTON, S.L.U., Orcoyen (ES)

( * ) Notice: Subject to any disclaimer, the term of this patent is extended or adjusted under 35 U.S.C. 154(b) by 428 days.

(21) Appl. No.: 17/285,221

(22) PCT Filed: Oct. 8, 2019

(86) PCT No.: PCT/ES2019/070677
§ 371 (c)(1),
(2) Date: Apr. 14, 2021

(87) PCT Pub. No.: WO2020/079297
PCT Pub. Date: Apr. 23, 2020

(65) Prior Publication Data

US 2021/0384671 A1 Dec. 9, 2021

(30) Foreign Application Priority Data

Oct. 15, 2018 (ES) ..... ES201831556U

(51) Int. Cl.
*H01R 13/627* (2006.01)
*H01R 13/502* (2006.01)
(Continued)

(52) U.S. Cl.
CPC ..... *H01R 13/6273* (2013.01); *H01R 13/502* (2013.01); *H01R 13/631* (2013.01); *H01R 13/639* (2013.01)

(58) Field of Classification Search
CPC ..... H01R 13/6273; H01R 13/502; H01R 13/631; H01R 13/639; H01R 13/641
See application file for complete search history.

(56) References Cited

U.S. PATENT DOCUMENTS 5,984,705 A * 11/1999 Miyazaki ..... H01R 13/703 340/687
8,052,458 B2 * 11/2011 Rossman ..... H01R 13/6456 439/358
(Continued)

FOREIGN PATENT DOCUMENTS

DE 1590655 A 5/1970
DE 102013113631 B3 4/2015
(Continued)

*Primary Examiner* — Abdullah A Riyami
*Assistant Examiner* — Nader J Alhawamdeh
(74) *Attorney, Agent, or Firm* — The Webb Law Firm

(57) ABSTRACT

A connector for supplying electric power to a machine or other devices that require electrical energy, the connector facilitating and securing the connection, thereby preventing possible accidental disconnection. The connector comprises a male connector element, a protective piece, and a blocking device that, in a closed position of the connector, provides double blocking on a single element forming part of the male connector element, to prevent the connector of the invention from disconnecting. The blocking device is configured to block pins from tilting in the closed position of the connector, wherein the blocking device comprises rear projections solidly connected to the protective piece, and end portions solidly connected to the pins.

10 Claims, 2 Drawing Sheets

(51) Int. Cl.
*H01R 13/631* (2006.01)
*H01R 13/639* (2006.01)

(56) References Cited

U.S. PATENT DOCUMENTS

| | | | | |
|---|---|---|---|---|
| 8,092,245 | B2 * | 1/2012 | Morello | H01R 13/6272 439/352 |
| 9,570,846 | B2 | 2/2017 | Lueckemeier | |
| 10,826,232 | B2 * | 11/2020 | Atalay | H01R 24/22 |
| 2010/0062635 | A1 * | 3/2010 | Jones, Jr. | H01R 13/6272 439/370 |
| 2010/0093204 | A1 | 4/2010 | Morello et al. | |
| 2011/0244706 | A1 * | 10/2011 | Rohde | H01R 13/6272 439/357 |
| 2015/0111407 | A1 | 4/2015 | Hashimoto | |
| 2015/0295357 | A1 | 10/2015 | Campbell et al. | |
| 2021/0384671 | A1 * | 12/2021 | Goñi Mateos | H01R 13/6273 |

FOREIGN PATENT DOCUMENTS

| | | | | | |
|---|---|---|---|---|---|
| GB | 1048230 | A | * | 11/1966 | H01R 23/62 |
| GB | 1048230 | A | | 11/1966 | |
| GB | 2376576 | A | | 12/2002 | |
| JP | 2000082538 | A | | 3/2000 | |

* cited by examiner

CONNECTOR FOR SUPPLYING ELECTRIC POWER

CROSS-REFERENCE TO RELATED APPLICATIONS

This application is the United States national phase of International Application No. PCT/ES2019/070677 filed Oct. 8, 2019, and claims priority to Spanish Patent Application No. U201831556 filed Oct. 15, 2018, the disclosures of which are hereby incorporated by reference in their entirety.

BACKGROUND OF THE INVENTION

Field of the Invention

The present invention relates to a connector for supplying electric power to a machine or other devices that require electrical energy, the connector of the invention facilitating and securing the connection, thereby preventing possible accidental disconnection. The connector of the invention includes a reinforced blocking device in a closed position of the connector, wherein double blocking on a single element forming part of the male connector element to prevent the connector of the invention from disconnecting stands out.

Description of Related Art

Today, both fixed and portable hot melt adhesive machines require electric power supply which acts on resistors, as well as on other electrical elements and devices, such that sufficient heat is provided to keep the adhesive in liquid state as it travels to nozzles through which said adhesive is ejected for application.

To supply this electric power, connectors which are in charge of joining each machine to the corresponding electric power source are used.

There are at present several types of electric power connectors for connecting power connectors to the machine.

Each of these connectors of the state of the art comprises a male connector element and a female connector element which are linked by means of a blocking system to prevent accidental disconnection.

The blocking system comprises different configurations and structures, according to the connector used.

For example, circular connectors, in which blocking between the male connector element and the female connector element is performed by means of threaded nuts or with other elements equivalent to said threaded nuts, are known.

Rectangular connectors, in which blocking between the male connector element and the female connector element is mainly performed by means of lever elements configured for being able to rotate or deform at a point, are also known.

The problem of the rotating lever elements is that they often run the risk of accidentally breaking during the blocking process, and also said lever elements can break when they receive impacts.

The problem of the deforming lever elements is that they are particularly sensitive to breakage because their design per se, which allows deformation, makes them fragile.

Specifically, machines for applying adhesive use a rectangular connector with two pins attached to the male connector element at a central region allowing the pins to work as lever elements.

Said pins incorporate chamferings required for stiffening the pins and thereby securing the closure and blocking of the connector.

The use of the chamferings generates a series of problems in the pins. On one hand, these chamferings weaken the pins, causing a poor blocking of the connector, and on the other hand, the stiffness of the pins caused by the chamferings leads to said pins being more fragile, and therefore to break more easily.

Likewise, this blocking system for conventional connectors generates problems in the blocking or closure of the connector because, since the pins are so stiff, a larger force must be exerted on said pins for opening and for the engagement thereof in the female connector element. In many cases, this leads to the connector not being well secured in its blocking position and the male connector element coming off the female connector element with the serious damaging effects that this entails, such as, for example, the cooling of the adhesive and the solidification thereof in the heat melt adhesive machines.

U.S. Patent Publication No. 20015295357 relates to a connector for supplying electric power having a device for securing the connector when it is in the closed position. Said connector includes a blocking system comprising a sliding element with a tubular structure, a connector body, a first projection solidly connected to the sliding element, and a second projection solidly connected to the connector body, wherein the first projection and the second projection are configured for being anchored to one another in a closed position of the connector.

This connector of U.S. Patent Publication No. 20015295357 continues to use only one blocking element, which does not entirely assure a reliable closure of the connector.

SUMMARY OF THE INVENTION

In order to achieve the objectives and prevent the drawbacks mentioned in the preceding sections, the proposed solution is a connector for supplying electric power comprising at least one male connector element and a protective piece with a tubular structure which is configured for being coupled to and moved axially in a guided manner along at least the male connector element.

The male connector element comprises a main body and protruding pins attached, at regions of their central parts, to the main body of said male connector element, wherein the pins include longitudinal ribs and end flanges configured for being anchored in flanges of a female connector element when the male connector element is connected to the female connector element in a closed position of the connector in which the protective piece is located in a forward position towards the female connector element.

The connector of the proposed solution further comprises a blocking device for the pins configured to block the pins from tilting in the closed position of the connector.

The blocking device comprises rear projections solidly connected to the protective piece and end portions solidly connected to the pins.

The rear projections of the protective piece include first inclined areas and the end portions of the pins of the male connector element include second inclined areas, wherein the end portions of the pins are located in regions opposite the end flanges of said pins.

The protective piece comprises front projections, wherein the front projections and the rear projections are located in opposite end openings of the protective piece with a tubular structure.

In the closed position of the connector, the first inclined areas of the rear projections of the protective piece and the second inclined areas of the end portions of the pins of the male connector element provide a wedged fitting formed by the contact between the first inclined areas and the second inclined areas.

The connector of the proposed solution comprises an anchoring device configured for immobilizing the protective piece with respect to the male connector element in the closed position of the connector coinciding with the wedged fitting of the first inclined areas and second inclined areas.

The anchoring device comprises lugs solidly connected to the male connector element and holes located in the protective piece, wherein the lugs are configured for being inserted in the holes in the closed position of the connector.

The holes of the anchoring device are located at the end of guides located on inner surfaces of said protective piece, wherein the lugs are housed and guided in said guides.

The protective piece comprises inner surfaces which are configured for contacting the longitudinal ribs of the pins of the male connector element in an open position of the connector, wherein the open position of the connector is a position in which the protective piece is located in a backward position opposite the forward position of said protective piece, which facilitates the attachment between the male connector element and the female connector element during the movement of the male connector element towards the female connector element.

The connector of the proposed solution comprises an axial retention device configured for preventing the separation of the protective piece with respect to the male connector element.

Said axial retention device comprises the front projections solidly connected to the protective piece and front steppings located in the longitudinal ribs of the male connector element, wherein in an axial retention position of the protective piece the front projections abut against the front steppings of the longitudinal ribs.

In an embodiment of the proposed solution, the connector comprises a cover that is attached to the male connector element in one and the same axial direction as a continuation of an end segment of the male connector element.

Next, to help better understand this specification and as an integral part thereof, a series of figures is attached in which the proposed solution is depicted in an illustrative and non-limiting manner.

DETAILED DESCRIPTION OF THE EMBODIMENTS

Figure 1:
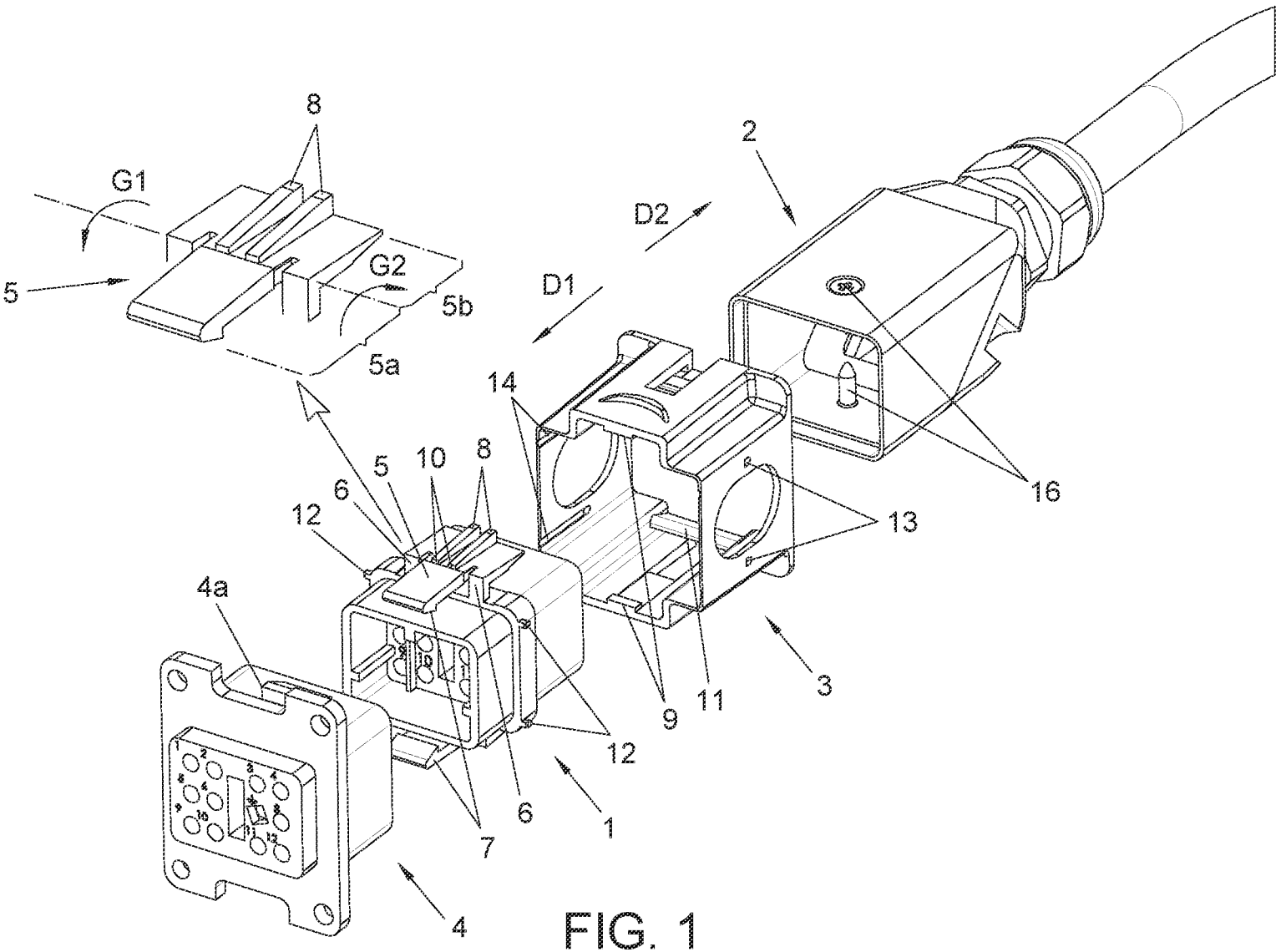
FIG. 1 shows an exploded perspective view of the connector for supplying electric power, object of the invention.
Figure 2:
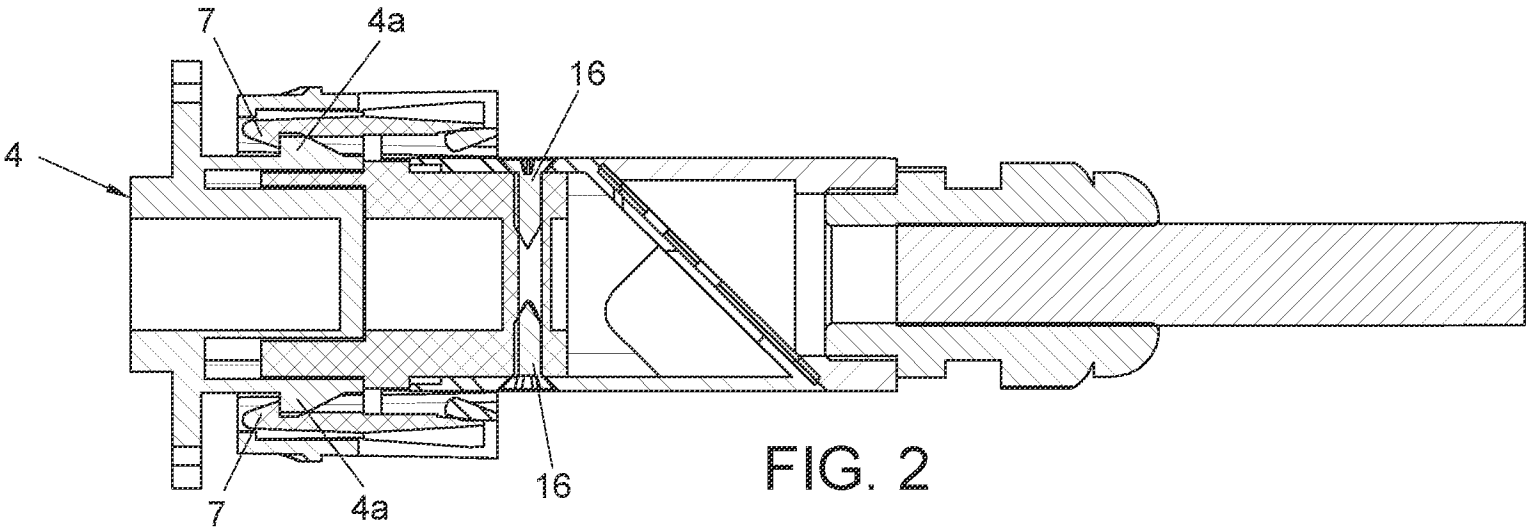
FIG. 2 shows a cross-sectional view of the connector in which a male connector element is attached to a female connector element in a closed position with blocking.
Figure 3:
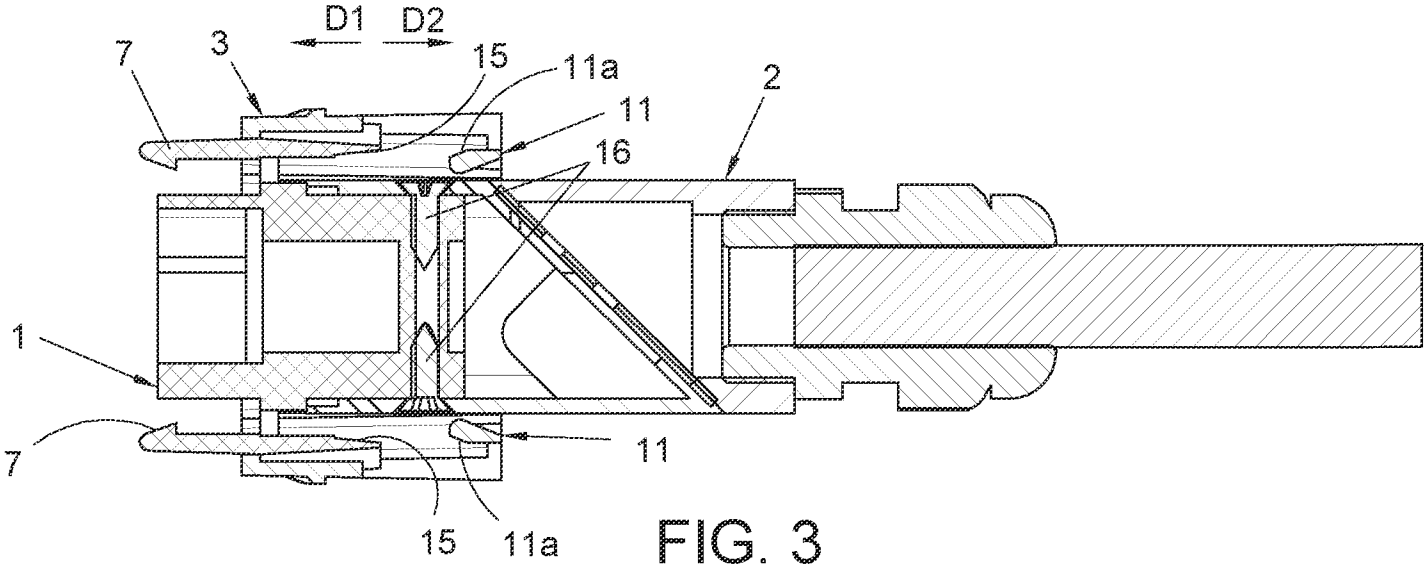
FIG. 3 shows a cross-sectional view of the connector in a disconnected position.

Taking into consideration the numbering adopted in the figures, the connector for supplying electric power comprises a male connector element 1, a cover 2, and a protective piece 3 with a tubular structure which is configured for being coupled to and moved axially in a guided manner along the assembly of the male connector element 1 and the cover 2, wherein the male connector element 1 is attached to the cover 2 by means of screws 16.

The male connector element 1 is configured for being able to be connected to a female connector element 4, such that when the male connector element 1 and the female connector element 4 are connected to one another, the connection thereof is secured by means of a blocking device that includes elements of the protective piece 3 and other elements of the male connector element 1; all of this is in accordance with the description below.

The male connector element 1 includes two protruding pins 5 attached to opposite regions of said male connector element 1 by means of attachment elements 6, wherein each of said pins 5 includes a first part 5*a* and a second part 5*b*, such that the pins 5 can tilt, in a first direction of rotation G1 or in a second direction of rotation G2, so as to be placed in different planes depending on the axial positioning of the protective piece 3 along the assembly of the male connector element 1 and the cover 2.

Each of the attachment elements 6 comprises pairs of side appendages located in an intermediate region in which the first part 5*a* and the second part 5*b* of the respective pin 5 come together, wherein said side appendages are solidly connected to the second part 5*b* having a larger width than the first part 5*a* of said pin 5.

The first parts 5*a* of the pins 5 include end flanges 7 that are complementary to other flanges 4*a* solidly connected to the female connector element 4 to enable ensuring that the male connector element 1 is anchored to the female connector element 4 in the closed position of the connector of the invention. In contrast, the second parts 5*b* of the pins 5 include wedge-shaped longitudinal ribs 8.

The protective piece 3 can move axially forward in a first axial direction D1, i.e., towards the female connector element 4, to enable blocking the closure of the connector to ensure that the male connector element 1 engages the female connector element 4; and the protective piece 3 can also move axially backward (towards the cover 2) in a second axial direction D2 to enable releasing said closure, and thereby opening the connector so as to enable separating the male connector element 1 from the female connector element 4.

The protective piece 3 includes front projections 9 that are complementary to front steppings 10 located in the longitudinal ribs 8 of the male connector element 1.

The protective piece 3 includes rear projections 11 that are complementary to end portions of the pins 5 constituting the blocking device which secures the connection and blocking of the connector when the male connector element 1 is attached to the female connector element 4 in the closed position.

The front projections 9 and the rear projections 11 are located in opposite end openings of the protective piece 3 with a tubular structure.

Said front projections 9 and the front steppings 10 constitute an axial retention device configured for preventing the separation of the protective piece 3 with respect to the male connector element 1 when said protective piece 3 is moved axially in the second axial direction D2 guided in the male connector element 1 until the front projections 9 abut against the front steppings 10 of the longitudinal ribs 8 solidly connected to the pins 5 of the male connector element 1. In this situation, the protective piece 3 is located in a rear end position limited by the described retention device.

During the axial movement of the protective piece 3 in the second axial movement direction D2, inner surfaces of the protective piece 3 contact the longitudinal ribs 8 of the pins 5, causing said pins 5 to tilt in the second direction of rotation G2; wherein in this operation of axial movement of the protective piece 3, the end flanges 7 of the pins 5 disengage from the flanges 4*a* of the female connector element 4, whereby the disassembly or unplugging of the connector is facilitated in this situation, separating the male connector element 1 from the female connector element 4.

The contact of the inner surfaces of the protective piece 3 on the longitudinal ribs 8 of the pins 5 also facilitates the assembly of the connector. In this situation, the contact between the inner surfaces of the protective piece 3 on the longitudinal ribs 8 of the pins 5 causes the distance between the end flanges 7 of the pins 5 to be greater than when the end flanges 7 are engaged in the flanges 4*a* of the female connector element 4, facilitating attachment between the male connector element 1 and the female connector element 4.

When the inner surfaces of the protective piece 3 are in contact with the longitudinal ribs 8 of the pins 5, the connector is in an open position prepared for carrying out both the assembly or plugging-in of the connector and the disassembly or unplugging of the connector.

In contrast, when the male connector element 1 is plugged in or connected to the female connector element 4 in the closed position in which the end flanges 7 are engaged in the flanges 4*a* of the female connector element 4, to secure the blocking of said closure, the protective piece 3 is moved axially towards the first axial direction D1 until the first inclined areas 11*a* of the rear projections 11 of the protective piece 3 contact the second inclined areas 15 of the end portions of the second parts 5*b* of the pins 5, such that said rear projections 11 tend to drive the tilting of the pins 5 in the first direction of rotation G1 to secure and block said pins 5 in the closed position of the connector.

Contacts between the first inclined areas 11*a* of the rear projections 11 of the protective piece 3 and the second inclined areas 15 of the end portions of the second parts 5*b* of the pins 5 are inclined contacts, providing a wedged fitting which reinforces the closure of the connector.

Finally, to more reliably assure closure blocking, the male connector element 1 includes lugs 12 that are complementary to holes 13 located in the protective piece 3, wherein the holes 13 are located at the end of guides 14 located on inner surfaces of said protective piece 3.

The lugs 12 are housed and guided in said guides 14, such that in the closed position of the connector the lugs 12 are inserted in the holes 13 arranged at the end of the guides 14 of the protective piece 3, blocking the movement of said protective piece 3. The lugs 12 and the holes 13 constitute an anchoring device which immobilizes the protective piece 3 in the closed position of the connector of the invention.

The protective piece 3, which is moved axially guided along the outside of the assembly formed by the male connector element 1 and the cover 2 ensures the protection of the pins 5, facilitates the release of said pins 5 when the protective piece 3 is moved axially backward in the second axial direction D2 towards the cover 2, and assures the blocking of the pins 5 when the protective piece 3 is moved axially forward in the first axial direction D1 towards the female connector element 4.

With the connector of the invention, the connection quality of the hot melt adhesive equipment/machines and the quality of said equipment/machines are improved.

The invention claimed is:

1. A connector for supplying electric power, comprising:

at least one male connector element comprising a main body and a plurality of protruding pins attached centrally to the main body, the plurality of protruding pins further comprising longitudinal ribs, end flanges, and end portions having inclined areas and located opposite to the end flanges on the main body;

a protective piece having a tubular structure and configured for being coupled to and moving axially in a guided manner along the at least one male connector element, the protective piece further comprising rear projections having inclined areas which form a wedged fitting when coming into contact with the inclined areas of the end portions of the plurality of protruding pins of the at least one male connector element when the connector is in a closed position, such that the rear projections of the protective piece and the end portions of the protruding pins form a blocking device configured to block the protruding pins from tilting in the closed position of the connector; and at least one female connector element comprising flanges into which the end flanges of the at least one mail connector element can anchor when the connector is in a closed position, wherein the protective piece is located in a forward position towards the at least one female connector element.

2. The connector for supplying electric power according to claim 1 wherein the at least one male connector element further comprises lugs, and wherein the protective piece further comprises holes configured to receive the lugs of the at least one male connector element when the connector is in a closed position, such that the protective piece is immobilized with respect to the at least one male connector element.

3. The connector for supplying electric power according to claim 2, wherein the holes of the protective piece are located at the ends of guides located on inner surfaces of the protective piece, wherein the lugs are housed and guided in the guides.

4. The connector for supplying electric power according to claim 1, further comprising a cover that is attached to the male connector element in one and the same axial direction.

5. The connector for supplying electric power according to claim 4, wherein the protective piece comprises inner surfaces which are configured for contacting the longitudinal ribs of the pins an open position of the connector, and wherein an open position of the connector is a position in which the protective piece is located in a backward position, towards the cover, opposite the forward position of the protective piece.

6. The connector for supplying electric power according to claim 1, wherein the protective piece further comprises front projections, wherein the front projections and the rear projections are located in opposite end openings of the protective piece with a tubular structure.

7. The connector for supplying electric power according to claim 1, further comprising an axial retention device configured for preventing the separation of the protective piece with respect to the male connector element;

the axial retention device comprising front projections solidly connected to the protective piece and front steppings located in the longitudinal ribs of the pins of the male connector element, wherein in an axial retention position of the protective piece and the front projections abut against the front steppings of the longitudinal ribs of the pins.

8. The connector for supplying electric power according to claim 2, further comprising a cover that is attached to the male connector element in one and the same axial direction.

9. The connector for supplying electric power according to claim 2, wherein the protective piece further comprises front projections, wherein the front projections and the rear projections are located in opposite end openings of the protective piece with a tubular structure.

10. The connector for supplying electric power according to claim 2, further comprising an axial retention device configured for preventing the separation of the protective piece with respect to the male connector element; the axial retention device comprising front projections solidly connected to the protective piece and front steppings located in the longitudinal ribs of the pins of the male connector element, wherein in an axial retention position of the protective piece and the front projections abut against the front steppings of the longitudinal ribs of the pins.

* * * * *